US005169484A

United States Patent [19]

Isowa et al.

[11] Patent Number: 5,169,484

[45] Date of Patent: Dec. 8, 1992

[54] DRIVE MECHANISM FOR SINGLE FACER IN CORRUGATOR

[75] Inventors: Eiichi Isowa, Nagoya; Toshihiko Yasui, Owariasahi, both of Japan

[73] Assignee: Isowa Industry Company Ltd., Aichi, Japan

[21] Appl. No.: 521,948

[22] Filed: May 11, 1990

[30] Foreign Application Priority Data

May 16, 1989 [JP] Japan ..... 1-123646

[51] Int. Cl.[5] ..... B31F 1/28

[52] U.S. Cl. ..... 156/471; 156/472

[58] Field of Search ..... 156/470, 471, 472, 473, 156/474, 205, 210, 555, 462

[56] References Cited

U.S. PATENT DOCUMENTS 2,289,909 7/1942 Greenwood ..... 156/472

4,814,038 3/1989 Hayashi et al. ..... 156/472 X

*Primary Examiner*—Michael W. Ball

*Assistant Examiner*—Michele K. Yoder

*Attorney, Agent, or Firm*—Schwartz & Weinrieb

[57] ABSTRACT

Disclosed is a drive mechanism for a single facer having a first fluted roll unit consisting of a pair of outer and inner fluted rolls, a second fluted roll unit also consisting of a pair of outer and inner fluted rolls, and a press roll, wherein the press roll is designed to be operated selectively in combination with the first fluted roll unit or with the second fluted roll unit; characterized in that the drive mechanism comprises: a drive gear to be rotated by a suitable drive means fixed upon a drive shaft which is drivingly connected to a rotary shaft of the press roll in such a way that the drive shaft may be rotated integrally with the rotary shaft; a driven gear mounted upon a driven shaft which is connected to the rotary shaft of the outer or inner fluted roll in each of the first and second fluted roll units, to be integrally rotatable with the rotary shaft, the driven gear being freely rotatable upon the driven shaft under engagement with the drive gear; a clutch for achieving ON/-OFF shifting of power transmission from the driven gear to the driven shaft; and a power transmitting member disposed upon the driven shaft with a one-way clutch, which is rotated by an idling drive means when the former clutch is released.

11 Claims, 6 Drawing Sheets

(b)

DRIVE MECHANISM FOR SINGLE FACER IN CORRUGATOR

FIELD OF THE INVENTION

This invention relates to a drive mechanism for a single facer having a plurality of fluted roll units, which can selectively form a single-faced corrugated board with any one of several different types of corrugations or flutes by using a desired fluted roll unit and which can allow the other fluted roll unit or units to be disposed in a stand-by or idling mode.

BACKGROUND OF THE INVENTION

There is known a single facer which forms a single-faced corrugated board by forming a corrugated medium so as to have a corrugation with a predetermined pitch size, and providing the medium with a liner upon the crests of the corrugation by using a suitable adhesive. The single facer comprises an outer fluted roll and an inner fluted roll both having flutes upon the circumferential portions thereof and rotatably supported upon a frame in such a way that their fluted circumferences may be engaged with each other in a vertical relationship, and a press roll which is designed to be brought into press contact with the inner fluted roll through means of the corrugated medium and liner. The corrugated medium is formed so as to have predetermined flutes or corrugations as it is fed between the outer fluted roll and the inner fluted roll under engagement of their fluted circumferences, and in addition glue is applied to the crests of the corrugations by means of a gluing roll provided within a gluing mechanism. The liner being fed from the opposite side of the press roll with respect to the corrugated medium, is bonded to the crests of the corrugated medium being pressed against the lower fluted roll by means of the press roll as it passes therebetween so as to form a single-faced corrugated board.

Single-faced corrugated boards are generally classified into Flute A, Flute B, Flute C, Flute D and Flute E type boards depending upon the depth of the flutes formed upon the corrugated medium and the standard number of crests per 30 cm. Such flute type can be selected depending upon the shapes of the fluted circumferences of the outer and inner fluted rolls to be disposed within the single facer apparatus or system.

As described above, there are many flute types to be used in connection with the formation of the single-faced corrugated board and the corrugation type is dependent upon the shape of the flutes formed upon the surfaces of the outer and inner fluted rolls incorporated within the single facer. Accordingly, in order to form different types of single-faced corrugated boards in one single facer, there has been employed a constitution, in which a plurality of single facers are arranged in the corrugator line in order to facilitate selective shifting of the board components to the desired single facer.

As an example of a prior art system of arranging, for example, two single facers, there is a tandem system in which two single facers are serially arranged along the corrugator line and a double deck system in which one single facer is stacked or disposed upon top of o above the other within the corrugator line. Both of these systems involve various problems for practical applications including the installation area, workability and incidental equipment, while it is also obvious that the cost of the apparatus is almost doubled due to the use of two single facers. Thus, it is common to selectively use a pair of fluted roll units each having fluted rolls with different types of flutes disposed within one single facer so as to form two different flute types of single-faced corrugated boards.

The outer and inner fluted rolls constituting each fluted roll unit are allowed to perform normal rotation while being heated to a predetermined temperature by means of feeding steam into internal spaces thereof. Accordingly, when shifting is made from the fluted roll unit under operation to the other unit on stand-by in order to change the flute type, the pair of fluted rolls on stand-by must be preliminarily heated by means of feeding steam thereto for immediately starting formation of a single-faced corrugated board with a different flute type.

However, in the system where a pair of fluted roll units are disposed within one single facer, the outer and inner fluted rolls constituting the stand-by fluted roll unit are separated from the drive unit, so that, if steam is fed to the stand-by outer and inner fluted rolls, it is condensed into water drops which accumulate upon the lower portions thereof so as to cool such portions, leading to the disadvantageous uneven heating of the fluted rolls. Namely, if the fluted rolls are heated unevenly, they tend to exhibit a non-uniform coefficient of thermal expansion, which causes a serious problem of non-uniformity in the shape of the flutes formed along the circumferential portions thereof. Therefore, currently used techniques for changing the flute type is to first implement shifting of the system to the desired fluted roll unit; the selected fluted roll unit is then connected to the drive unit: and subsequently steam is fed to the outer and inner fluted rolls so as to heat them before starting the normal rotation thereof. However, such technique disadvantageously takes time for completing the flute type changing operation.

While the above problems can be solved by allowing the standby outer and inner fluted rolls to be disposed in an idle mode while steam is supplied thereto there remains the problem, in connection with such type of single facer having a pair of fluted roll units of actually achieving the shifting operation, for the respective fluted roll unit, between the normal rotation mode and the idling mode.

OBJECT OF THE INVENTION

This invention has been proposed in view of the disadvantageous problems inherent in the prior art single facers comprising a pair of fluted roll units which can form single-faced corrugated boards of two different flute types and to overcome them in a successful manner, and is directed to provide a means having a simple structure which can readily achieve shifting operation between the normal rotation and idling modes.

SUMMARY OF THE INVENTION

In order to solve the above problems and to achieve the intended object successfully, this invention provides a drive mechanism for a single facer having a first fluted roll unit consisting of a pair of outer and inner fluted rolls, a second fluted roll unit also consisting of a pair of outer and inner fluted rolls, and a press roll, wherein the press roll is designed to be selectively operated in combination with the first fluted roll unit or with the second fluted roll unit; characterized in that the drive mechanism comprises:

a drive gear to be rotated by a suitable drive means fixed upon a drive shaft connected to a rotary shaft of the press roll in such a way that the drive shaft may be rotated integrally with the rotary shaft;

a driven gear mounted upon a driven shaft connected to the rotary shaft of the outer and inner fluted roll in each of the first and second fluted roll units, to be integrally rotatable with the rotary shaft, the driven gear being freely rotatable upon the driven shaft as a result of the engagement with the drive gear;

a clutch for achieving ON/OFF shifting of power transmission from the driven gear to the driven shaft; and a power transmitting member disposed upon the driven shaft with a one-way clutch, which is rotated by an idling drive means when the former clutch is released.

According to the drive mechanism for the single facer of this invention having such constitution, the driven shaft and the driven gear can be integrally rotated by means of actuating either the clutch of the first fluted roll unit or of the second fluted roll unit which is to be selectively operated in combination with the press roll, whereas the driven gear can be freely rotated upon the driven shaft by releasing the clutch of the stand-by first or second fluted roll unit. Furthermore, the driven shaft can be rotated by the idling drive means.

As has been described above, according to the present invention single facer drive mechanism, the outer fluted roll and the inner fluted roll of the stand-by fluted roll unit can be uniformly preheated by feeding steam thereto since they are allowed to undergo an idling function or operation. Accordingly, as soon as shifting is made from the fluted roll unit under operation to the stand-by fluted roll unit for implementing the change of flute type, formation of a new flute type of single-faced corrugated board can be started, so that the cycle time therefore can be reduced. Since the power shifting between the normal rotation mode and the idling mode can be readily made by means of the simple clutch shifting operation, the design of the power transmission mechanism can be extremely simplified so as to advantageously lower the production costs.

BRIEF DESCRIPTION OF THE DRAWINGS

Various other objects, features, and attendant advantages of the present invention will become better understood from the following detailed description when considered in connection with the accompanying drawings, in which like reference characters designate like or corresponding parts throughout the several views, and wherein:

FIG. 5(*a*) and (*b*) are explanatory views of the power transmission system shown in FIG. 3 taken along Line 5—5 wherein:

FIG. 5(*a*) illustrates the system wherein the first fluted roll unit is forming a single-faced corrugated board in combination with the press roll while the second fluted roll unit is suspended from normal rotation and is disposed in an idling mode; and FIG. 5(*b*) illustrates the system wherein the second fluted roll unit is forming a single-faced corrugated board in combination with the press roll while the first fluted roll unit is suspended from normal rotation and is disposed in an idling mode.

PREFERRED EMBODIMENT OF THE INVENTION

Next, the single facer drive mechanism is this invention will be described below by way of a preferred embodiment while referring to the attached drawings. It should be noted here that the single facer in which the present drive mechanism is realized is of a type having a pair of fluted roll units. Therefore, the constitution of the single facer will first be described briefly.

Figure 1:
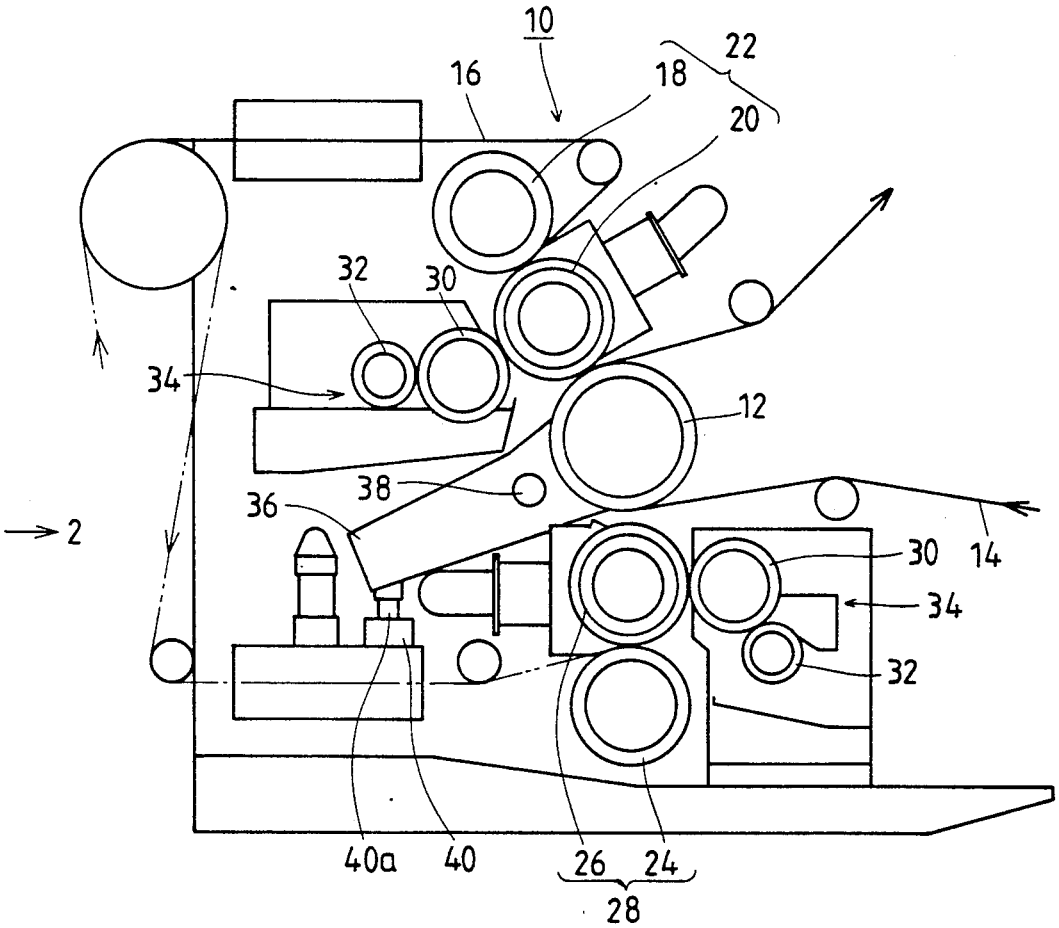
FIG. 1 schematically shows the construction of a single facer in which a preferred embodiment of the drive mechanism of this invention is realized.

FIG. 1 schematically shows the constitution of a single facer 10 in which the drive mechanism according to the present embodiment is realized, wherein the reference number 12 shows a press roll for guiding a liner 14 and bonding it to the glued crests of a corrugated medium 16. Diagonally above the press roll 12 is disposed a first fluted roll unit comprising a pair of fluted rolls, that is, an outer fluted roll 18 and an inner fluted roll 20; whereas below the press roll 12 there is similarly disposed a second fluted roll unit 28 also comprising a pair of fluted rolls, that is, an outer roll 24 and an inner fluted roll 26.

Figure 2:
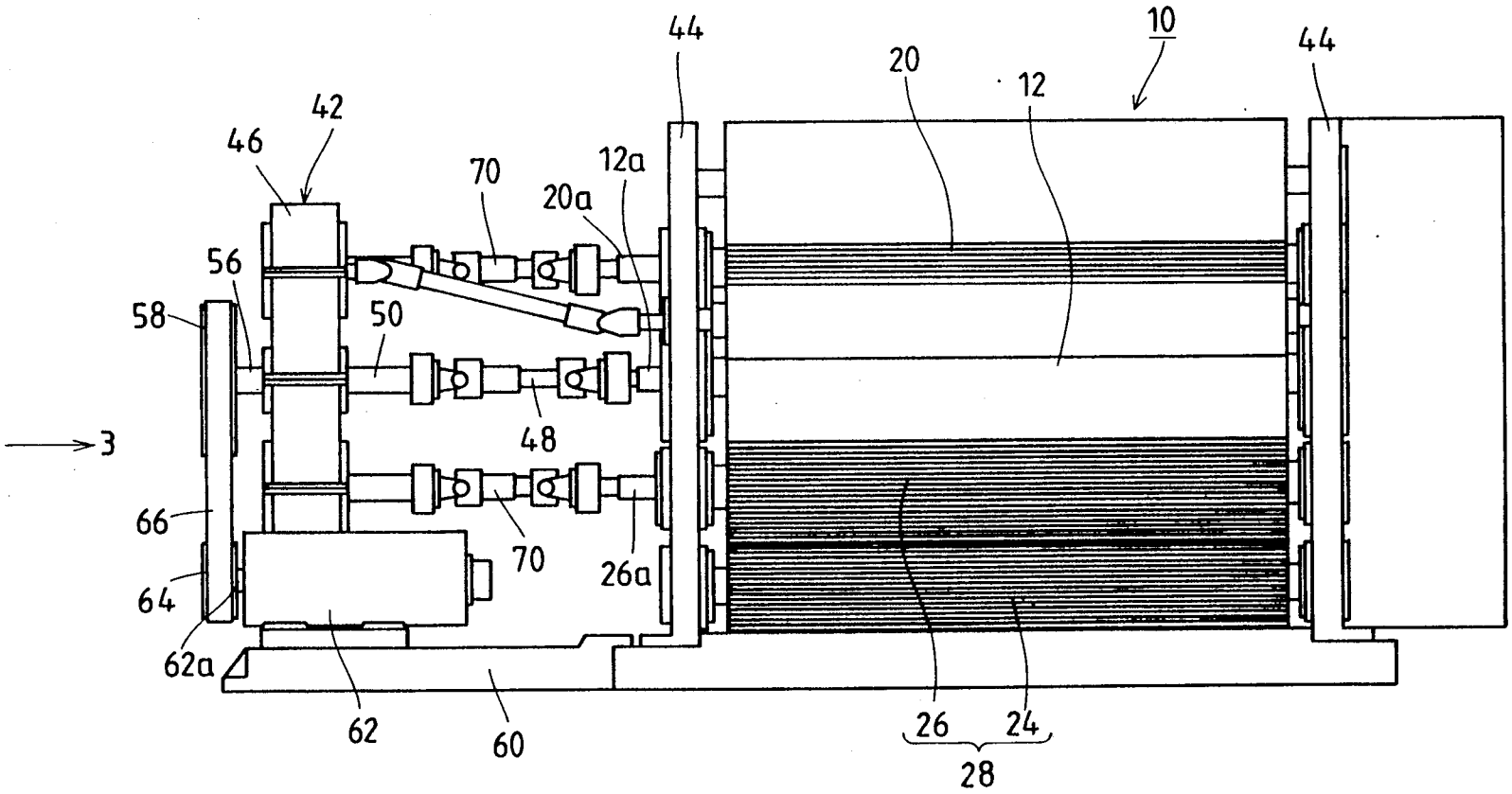
FIG. 2 is a side view of the single facer shown in FIG. 1 as viewed from the direction indicated by means of arrow 2.

These fluted rolls 18 and 20 of the first fluted roll unit 22 and the fluted rolls 24 and 26 of the second fluted roll unit 28 are rotatably supported upon a pair of fixed frames 44 which are laterally spaced with respect to each other with a predetermined space defined therebetween as shown in FIG. 2, wherein a predetermined combination of flute types are used for the first fluted roll unit 22 and that of the second fluted roll unit 28, such as, for example, combinations of Flutes A and F, Flute B and Flute E or Flute C, Flute E, and the like.

A gluing mechanism 34 comprising a gluing roll 30 and a doctor roll 32 is disposed in connection with the first fluted roll unit 22 and the second fluted roll unit 28, respectively. It should be noted here that the distinction between the outer fluted roll and the inner fluted roll is not made based upon the relative spatial relationship defined therebetween but is made relative to the press roll 12. Namely, it should be appreciated that those fluted rolls which are brought into press contact with the press roll 12 through means of the liner and the corrugated medium are referred to as "the inner fluted rolls."

In this basic arrangement, the press roll 12 is designed to be selectively shifted relative to the first fluted roll unit 22 and to the second fluted roll unit 28, so that the press roll 12 can be combined with the inner fluted roll 20 of the first fluted roll unit 22 or the inner fluted roll 26 of the second fluted roll unit 28 so as to form a single-faced corrugated board having a corrugation corresponding to the flute type of the fluted roll unit. In other words, the press roll 12 can be commonly used with the first fluted roll unit 22 and the second fluted roll unit 28, and such combination of the pres roll 12 with the inner fluted roll 20 or the inner fluted roll 26 can be achieved by (1) designing the press roll 12 as a moveable member, or (2) designing the first and second fluted roll units 22 and 28 as moveable units. The drive mechanism of this invention can be realized in connection with either one of the above two cases.

For example, FIG. 1 shows an embodiment in which the press roll 12 is the moveable member, wherein the press roll 12 is rotatably supported upon one end portion of a lever 36, and the lever 36 is pivotally supported at the middle portion thereof between a pair of frames 44 by means of pins 38. The other end portion of the lever 36 is connected to a piston rod 40*a* of a hydraulic cylinder 40 so that the press roll 12 can be reciprocated thereby as a result of the pivotal movement of the lever 36 about the pins 38. Namely, the ascending or descending movements of the piston rod 40*a* as a result of the activation of the hydraulic cylinder 40 can achieve shifting of the press roll 12 between the position where the press roll 20 of the first fluted roll unit 22 and the position where the press roll 12 is brought into contact with the inner fluted roll 26 of the second fluted roll unit 28.

In the thus constituted single facer 10, a power transmission mechanism 42 is disposed, which not only drives the first fluted roll unit 22 or the second fluted roll unit 28 so as to perform normal rotation for forming single-faced corrugated board in combination with the pres roll 12 but also allows the stand-by first fluted roll unit 22 o the second fluted roll unit 28 to perform an idling function.

Figure 4:
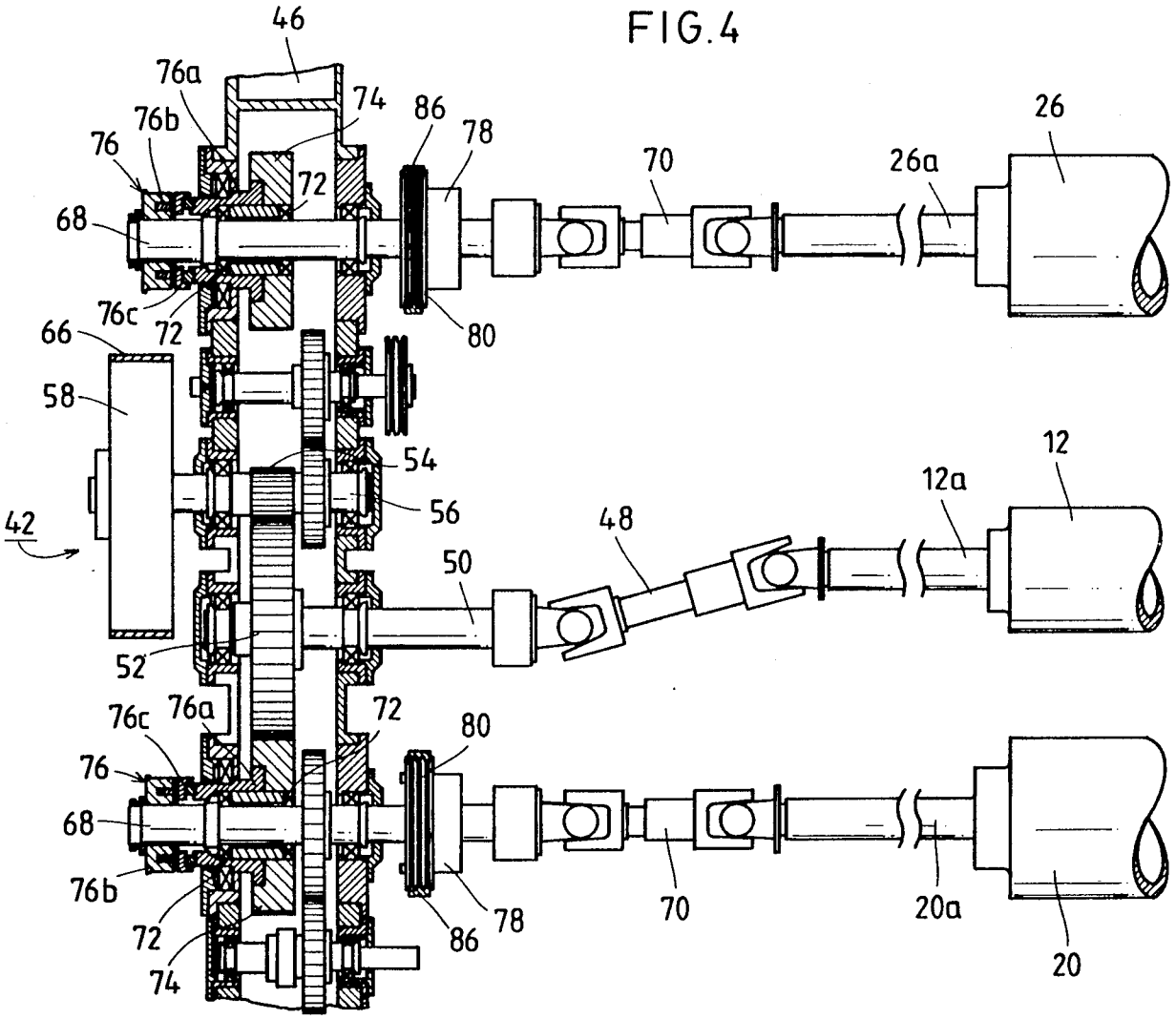
FIG. 4 shows the details of the power transmission system shown in plan view.

As shown in FIG. 2, a gear box 46 is disposed opposite one fixed frame 44 with a predetermined space therebetween, and one end of a rotary shaft 12*a* of the press roll 12, that is, the end facing the gear box 46, extends from the distal end of the lever 36 through means of a predetermined length, with one end of a universal joint 48 being connected to such end. The other end of the universal joint 48 is connected to one end of a drive shaft 50 rotatably supported within the gear box 46 as shown in FIG. 4 so that the press roll 12 may be rotatable integrally with the drive shaft 50.

At the site of the drive shaft 50 within the gear box 46, there is disposed a large-diameter drive gear 52 which rotates integrally with the drive shaft 50. Adjacent to the supporting position of the drive shaft 50 within the gear box 46, a rotary shaft 56 is rotatably supported parallel to the drive shaft 50, and a small-diameter gear 54 which engages with the drive gear 52 is disposed upon the rotary shaft 56. An outer end portion of the rotary shaft 56 relative to the fixed frame 44 extends with a predetermined length from the gear box 46, with a pulley 58 fitted thereon.

Figure 3:
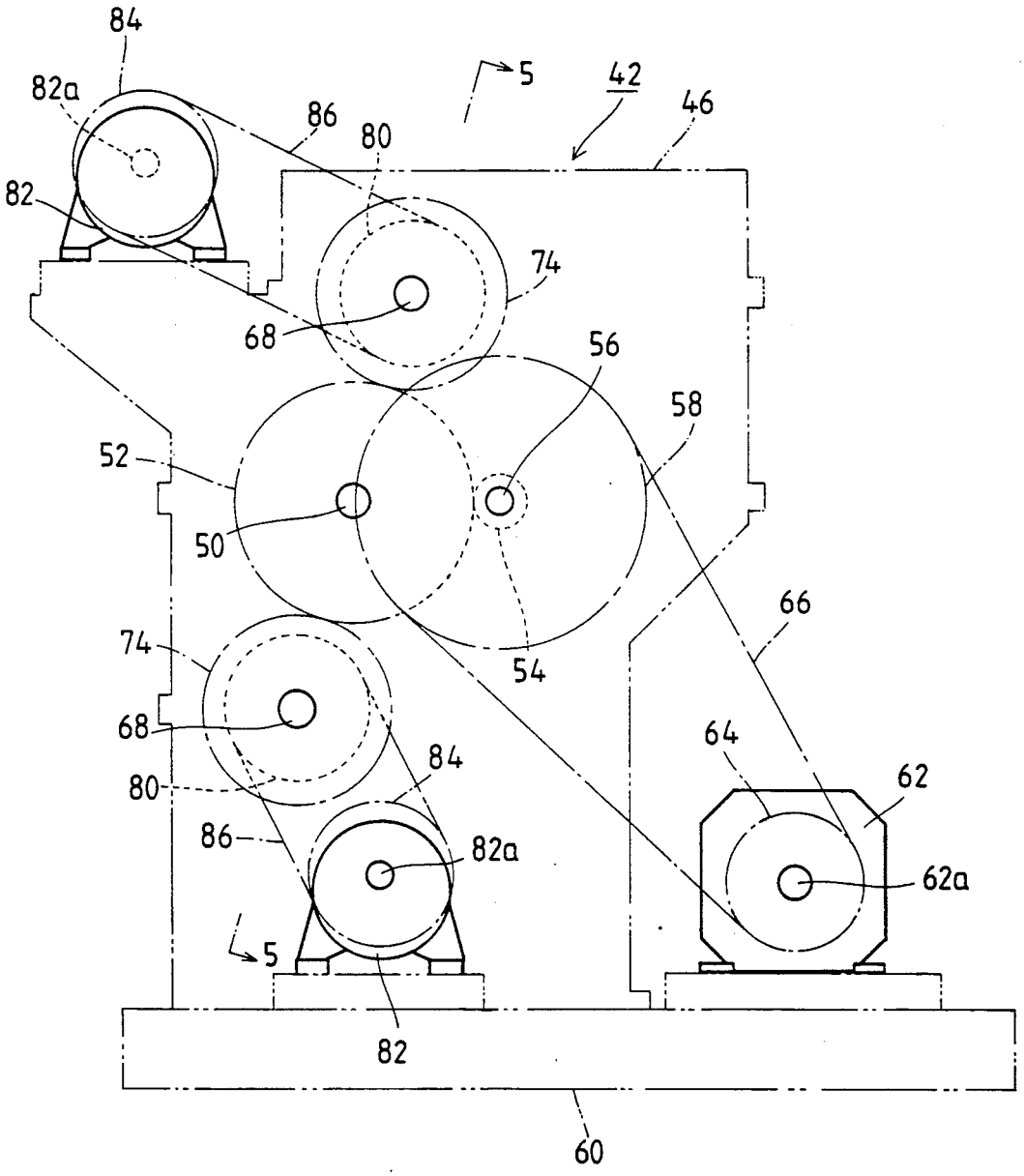
FIG. 3 is an explanatory drawing of the power transmission system shown in FIG. 2 as viewed from the direction indicated by means of arrow 3.

Furthermore, as shown in FIG. 3, a first drive means comprising a drive motor 62 is disposed upon a base 60 upon which the gear box 46 has been mounted, and an endless belt 66 is extended over and around the pulley 58 and another pulley 64 disposed upon a power shaft 62*a* of the drive motor 62. Accordingly, if the drive motor 62 is driven, rotation of the power shaft 62*a* is transmitted successively through the pulley 64→belt 66→pulley 58→rotary shaft 56→small-diameter gear 54→drive gear 52→drive shaft 50→universal joint 48 and finally to the rotary shaft 12*a* so as to drive the press roll 12 in order to perform normal rotation thereof.

Within the gear box 46 a pair of driven shafts 68 are rotatably supported in a vertical relationship relative to the drive shaft 50 as shown in FIG. 3, that is, one above and the other below the drive shaft 50, and these driven shafts 68 are connected to the rotary shafts 20*a* and 26*a* of the inner fluted rolls 20 and 26 through means of joints 70, respectively. A power shifting mechanism and an idling drive means are provided in connection with each driven shaft 68. Incidentally, since these two driven shafts 68 have the same shifting mechanism and the same idling drive means, only those for the driven shaft 68 of the first fluted roll unit 22 will be described. The respective members disposed within the second fluted roll unit 28 and identical to the counterparts within the first fluted roll unit 22 are shown with the same reference numbers, correspondingly.

At the site of the driven shaft 68 within the gear box 46 a driven gear 74 is mounted through means of a pair of bearings 72 in such a way that the driven gear 74 can be rotated freely relative to the driven shaft 68, as shown in FIG. 4. The driven gear 74 is engaged with the drive gear 52 and is designed to be rotated integrally with the drive gear 52 as a result of the driving of the drive motor 62. The ON/OFF power transmission shifting from the driven gear 74 to the driven shaft 68 can be achieved through means of a known clutch 76. As the clutch 76, a solenoid tooth clutch, comprising a drive member and a driven member each having a toothed surface to oppose the other to transmit power under engagement of their toothed surfaces, can be suitably employed.

To describe the same in detail, at the free end (that is, the end at which the rotary shaft 20*a* of the lower fluted roll 20 is not connected) of the driven shaft 68, a driven member 76*b*, a constituent of the clutch 76, is disposed such that it may be rotatable integrally with the driven shaft 68; while a drive member 76*a*, another constituent of the clutch 76, is disposed upon the driven gear 74 so as to face the driven member 76*b* so that the drive member 76*a* may be rotatable integrally with the driven gear 74. At the site of the first clutch component or drive member 76*a* facing the second clutch component or driven member 76*b*, a third clutch component or moveable member 76*c* is disposed, and the moveable member 76*c* is designed to be electromagnetically connected to the driven member 76*b* by energizing the clutch 76. Accordingly, upon energization of the clutch 76 so as to allow the moveable member 76*c* to be electromagnetically connected to the driven member 76*b*, power (rotation) from the driven gear 74 can be transmitted to the driven shaft 68 (see FIG. 5(*a*)); whereas upon deenergization of the clutch 76, the moveable member 76*c* is spaced from the driven member 76*b* so as to terminate the power transmission from the driven gear 74 to the driven shaft 68 (see FIG. 5 (*b*)).

According to such clutch mechanism, by actuating the clutch 76 on the side of the first fluted roll unit 22, which forms a single-faced corrugated board in combination with the press roll 12, as a result of the operation of the drive motor 62, the rotation of the driven gear 74 is transmitted to the driven shaft 68, whereby the inner fluted roll 20 is rotated in conjunction with the rotation of the press roll 12. On the other hand, by releasing the actuation of the clutch 76 upon the side of the stand-by second fluted roll unit 28, the power from the driven gear 74 cannot by transmitted to the driven shaft 68, whereby the driven shaft, that is, the inner fluted roll 26 of the second fluted roll unit 28 can perform an idling driving by means of an idling operation as a result of being motor 82 (to be described later) independent of the first fluted roll unit 22.

At the site of the driven shaft 68 adjacent to the junction with the joint 70, a pulley 80 is disposed through means of a one-way clutch 78, and an endless belt 86 is extended over and around the pulley 80 and another pulley 84 mounted upon the lower shaft 82*a* of the idling motor 82 disposed within the gear box 46, as shown in FIG. 3. As the idling motor 82, a relatively low-power motor which rotates at a low rate of speed compared with that of the drive motor 62 can be used. Thus, when the motor 82 is driven, the driven shaft 68 is forced to perform a predetermined rotation through means of the drive of the pulley 80, and in turn the inner fluted roll 20 of the first fluted roll unit 22 is allowed to perform an idling operation. The means for transmitting power from the idling motor 82 to the driven shaft 68 is not limited to the belt 86 and pulley 80 system, and such power transmission can similarly be achieved by means of a chain and sprocket system or a series of gears.

The outer fluted roll 18 is rotated integrally with the inner fluted roll 20 through means of gears and the like, not shown. For achieving the idling of the first fluted roll unit 22, the actuation of the clutch 76 must be released so that the power from the driven gear 74 cannot be transmitted to the driven shaft 68.

The pulley 80 provided in connection with the one-way clutch 78 is adapted to transmit power to the driven shaft 68 only when it is rotated by means of the idling motor 82. Accordingly, when the first fluted roll unit 22 is allowed to perform normal rotation for forming a single-faced corrugated board, the driven shaft 68 rotates freely relative to the pulley 80 and clutch 78, so that the rotation of the driven shaft is not hindered thereby.

OPERATION OF THE PREFERRED EMBODIMENT

The operation of the single facer drive mechanism of the preferred embodiment having such constitution as noted above will now be explained. For example, when a single-faced corrugated board is formed using a combination of the first fluted roll unit 22 and the press roll 12, the press roll 12 is shifted to the position, as shown in FIG. 5(*a*), where it can press the liner 14 and the corrugated medium 16, having had the liner glued to the crests thereof, against the inner fluted roll 20 of the first fluted roll unit 22 with an appropriate pressure.

In this combination, the clutch 76 disposed upon the driven shaft 68 connected to the rotary shaft 20*a* of the inner fluted roll 20 of the first fluted roll unit 22 is energized so as to allow the moveable member 76*c* adjacent the drive member 76*a* to be electromagnetically connected to the driven member 76*b* so that the rotation of the driven gear 74 may be transmitted to the driven shaft 68; while the energization of the clutch 76 disposed upon the driven shaft 68 connected to the rotary shaft 26*a* of the lower inner fluted roll 26 of the second fluted roll unit 28 is terminated so as to allow the movable member 76*c* adjacent the drive member 76*a* to be spaced from the driven member 76*b* so that the rotation of the driven gear 74 cannot be transmitted to the driven shaft 68.

In this state, the press roll 12 is rotated through means of the power transmission system by starting the drive motor 62. The driven shaft 68 of the first fluted roll unit 22 having the clutch 76 thereon is rotated by means of the power transmitted through the driven gear 74 under engagement with the drive gear 52, whereby the outer and inner fluted rolls 18 and 20 of the first fluted roll unit 22 can be rotated. Thus, formation of single-faced corrugated board is achieved between the press roll 12 and the first fluted roll unit 22.

Figure 5:
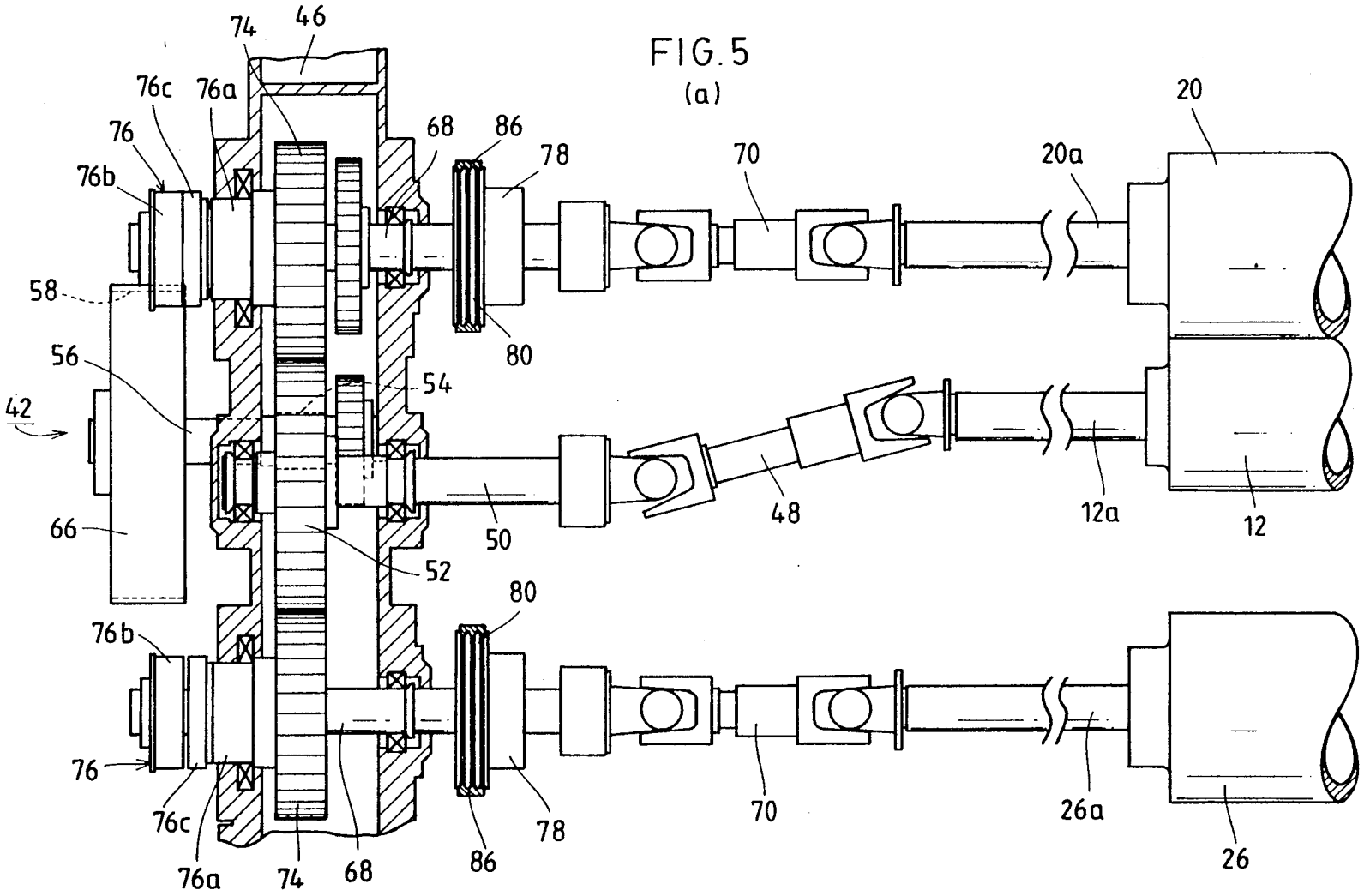
Figure 5:
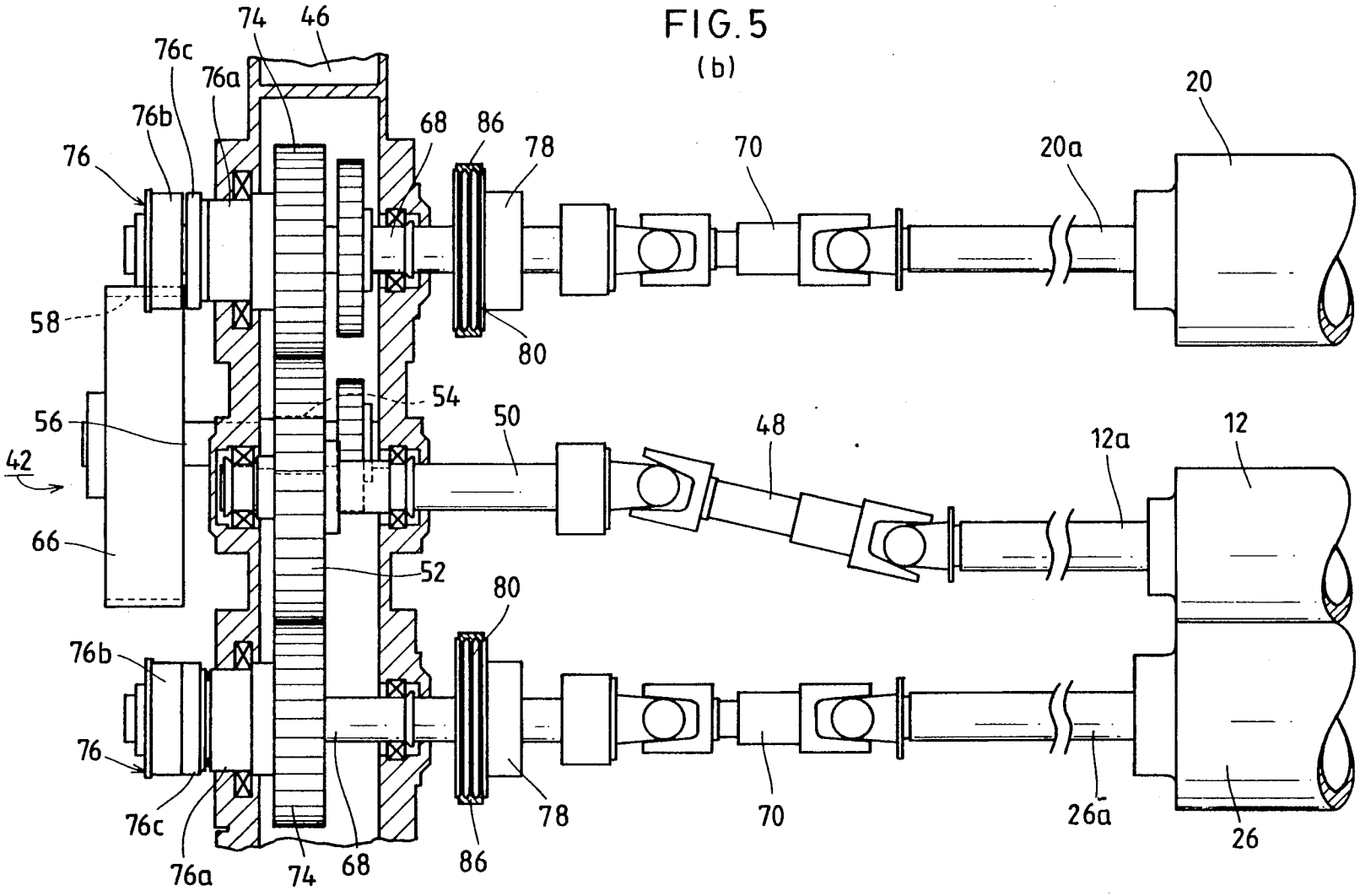

When the press roll 12 is performing the operation with the first fluted roll unit 22, the clutch 76 of the second fluted roll unit 28 on stand-by is released or deenergized (as shown in FIG. 5(*a*)), so that the power from the driven gear 74 is not transmitted to the driven shaft 68 and the driven gear 74 is rotating freely around the driven shaft 68. Accordingly, the pulley 80 disposed upon the driven shaft 68 is rotated by driving the idling motor 82, and also the driven shaft 68 is allowed to perform an idling operation through means of the one-way clutch 78. Namely, since the outer and inner fluted rolls 24 and 26 of the stand-by second fluted roll unit 28 are allowed to perform an idling operation, they can assume a stand-by posture whereby the same are heated uniformly by means of the steam fed thereto.

When formation of a single-faced corrugated board of a different flute type is started after the production of a single-faced corrugated board of a predetermined flute type (for example, Flute A) under the combination of the press roll 12 and the first fluted roll unit 22, the press roll 12 is shifted to the position where it is combined with the second fluted roll unit 28 as shown in FIG. 5(*b*).

With the shifting of the press roll 12, the clutch 76 upon the first fluted roll unit 22 is released so as to terminate the transmission of power from the driven gear 74 to the driven shaft 68, and also the clutch 76 of the second fluted roll unit 28 is actuated so that the rotational power of the driven gear 74 can be transmitted to the driven shaft 68. By driving the drive motor 62 in this state a single-faced corrugated board of another flute type can be formed by means of the combination of the press roll 12 and the second fluted roll unit 28. Furthermore, since the second fluted roll unit 28 has also bee heated during its stand-by period, formation of a different type of single-faced corrugated board can be started immediately after the shifting of the press roll 12 so as to require reduced cycle time therefore.

The outer and inner fluted rolls 18 and 20 of the first fluted roll unit 22 can therefore be allowed to perform an idling operation by rotating the pulley 80 for the first fluted roll unit 22 disposed in its stand-by mode as a result of being driven by means of the idling motor.

It should be noted that while the outer fluted rolls of the respective fluted roll units are designed to follow the rotation of the respective inner fluted rolls in the above preferred embodiment, this invention is not limited to such constitution, and it is of course possible to drive the outer fluted rolls of the respective fluted roll units so as to allow the respective inner fluted rolls to follow their rotation.

Obviously, many modifications and variations of the present invention are possible in light of the above teachings. It is therefore to be understood that within the scope of the appended claims, the present invention may be practiced otherwise than as specifically described herein.

What is claimed is:

1. A drive mechanism for a single facer having a first fluted roll unit comprising a pair of inner and outer fluted rolls, a second roll fluted roll unit comprising a pair of inner and outer fluted rolls, and a press roll, wherein the press roll is adapted to be selectively operated in combination with the first fluted roll unit or with the second fluted roll unit, comprising:

a first drive means;

a drive gear operatively connected to said first drive means so as to be driven by said first drive means, and mounted upon a drive shaft which is connected to said press roll such that said press roll is driven by said drive gear through means of said drive shaft;

a driven gear engaged with said drive gear so as to be driven by said drive gear, and mounted upon a driven shaft, which is connected to one of said inner or outer fluted rolls within one of said first and second fluted roll units, in a freely rotatable manner;

a clutch disposed upon said driven shaft and operatively interposed between said driven gear and said driven shaft so as to transmit power from said driven gear to said driven shaft when said clutch is ON and for disconnecting said driven gear from said driven shaft so as to terminate said power from said driven gear to said driven shaft when said clutch is OFF;

a second driven means;

a power transmitting member connected to said second drive means and mounted upon said driven shaft in a freely rotatable manner when said driven shaft is rotated in a predetermined rotary direction relative to said power transmitting member by said first drive means, said drive gear, and said driven gear with said clutch disposed in its ON mode; and one-way clutch means disposed upon said driven shaft and operatively interposed between said power transmitting member and said driven shaft for transmitting power from said second drive means and said power transmitting member to said driven shaft when said power transmitting member is rotated in a rotary direction, relative to said driven shaft, which is opposite to said predetermined rotary direction, such that said one of said inner or outer fluted rolls of said one of said first and second fluted roll units can be rotated by said second drive means in an idle rotary mode when said clutch is disposed in its OFF mode so as to terminate power from said driven gear to said driven shaft.

2. A drive mechanism for a single facer having a fluted roll unit comprising a pair of inner and outer fluted rolls, and a press roll which is adapted to be operated in combination with said fluted roll unit, comprising:

a first drive means;

a drive gear operatively connected to said first drive means so as to be driven by said first drive means, and mounted upon a drive shaft which is connected to said press roll such that said press roll is driven by said drive gear through means of said drive shaft;

a driven gear engaged with said drive gear so as to be driven by said drive gear, and mounted upon a driven shaft, which is connected to one of said inner or outer fluted rolls within said fluted roll unit, in a freely rotatable manner;

a clutch disposed upon said driven shaft and operatively interposed between said driven gear and said driven shaft so as to transmit power from said driven gear to said driven shaft when said clutch is ON and for disconnecting said driven gear from said driven shaft so as to terminate said power from said driven gear to said driven shaft when said clutch is OFF;

a second drive means;

a power transmitting member connected to said second drive means and mounted upon said driven shaft in a freely rotatable manner when said driven shaft is rotated in a predetermined rotary direction relative to said power transmitting member by said first drive means, said drive gear, and said driven gear with said clutch disposed in its ON mode; and one-way clutch means disposed upon said driven shaft and operatively interposed between said power transmitting member and said driven shaft for transmitting power from said second drive means and said power transmitting member to said driven shaft when said power transmitting member is rotated in a rotary direction, relative to said driven shaft, which is opposite to said predetermined rotary direction, such that said one of said inner or outer fluted rolls of said fluted roll unit can be rotated by said second drive means in an idle rotary mode when said clutch is disposed in its OFF mode so as to terminate power from said driven gear to said driven shaft.

3. A drive mechanism as set forth in claim 1, further comprising:

a pair of laterally spaced frames;

a lever pivotably supported upon said pair of laterally spaced frames at a substantially central portion thereof and having said press roll mounted upon one end thereof; and piston-cylinder drive means operatively connected to a second opposite end of said lever for selectively reciprocating said second opposite end of said lever between first and second positions such that said one end thereof, upon which said press roll is mounted, is correspondingly reciprocated between third and fourth positions whereby said press roll can be selectively operated in combination with said first or second fluted roll unit.

4. A drive mechanism as set forth in claim 1, wherein said first drive means comprises:

a drive motor;

a rotary shaft;

a small-diameter gear fixed upon said rotary shaft and operatively engaged with said drive gear;

a pulley fixed upon said rotary shaft at a position axially spaced from said small-diameter gear; and a pulley belt interconnecting said drive motor with said pulley.

5. A drive mechanism as set forth in claim 1, wherein: said clutch comprises a solenoid tooth clutch.

6. A drive mechanism as set forth in claim 5, wherein said solenoid tooth clutch comprises:

a first clutch component fixedly mounted upon said driven gear;

a second clutch component fixedly mounted upon said driven shaft; and a third clutch component movably mounted upon said driven shaft, in response to energization of said clutch, between a first position at which said third clutch component drivingly interconnects said first and second clutch components when said clutch is energized, and a second position at which said third clutch component drivingly disconnects said first and second clutch components when said clutch is de-energized.

7. A drive mechanism as set forth in claim 1, wherein: said second drive means comprises an idling motor; and said power transmitting member comprises a pulley drivingly interconnected with said second drive means idling motor by means of a pulley belt.

8. A drive mechanism as set forth in claim 2, wherein said first drive means comprises:

a drive motor;

a rotary shaft;

a small-diameter gear fixed upon said rotary shaft and operatively engaged with said drive gear;

a pulley fixed upon said rotary shaft at a position axially spaced from said small diameter gear; and a pulley belt interconnecting said drive motor and said pulley.

9. A drive mechanism as set forth in claim 2, wherein: said clutch comprises a solenoid tooth clutch.

10. A drive mechanism as set forth in claim 9, wherein said solenoid tooth clutch comprises:

a first clutch component fixedly mounted upon said driven gear;

a second clutch component fixedly mounted upon said driven shaft; and a third clutch component movably mounted upon said driven shaft, in response to energization and de-energization of said clutch, between a first position at which said third clutch component drivingly interconnects said first and second clutch components when said clutch is energized, and a second position at which said third clutch component drivingly disconnects said first and second clutch components when said clutch is de-energized.

11. A drive mechanism as set forth in claim 2, wherein:

said second drive means comprises an idling motor; and said power transmitting member comprises a pulley drivingly interconnected with said second drive means idling motor by means of a pulley belt.

* * * * *